US011729567B2

(12) United States Patent
Robert et al.

(10) Patent No.: US 11,729,567 B2
(45) Date of Patent: Aug. 15, 2023

(54) DEVICE FOR GENERATING SOUND MESSAGES AND ASSOCIATED VERIFICATION METHOD

(71) Applicant: THALES, Courbevoie (FR)

(72) Inventors: François Robert, Merignac (FR); Patrick Dervin, Merignac (FR); Jean-Christophe Reculeau, Merignac (FR)

(73) Assignee: THALES, Courbevoie (FR)

( * ) Notice: Subject to any disclaimer, the term of this patent is extended or adjusted under 35 U.S.C. 154(b) by 43 days.

(21) Appl. No.: 17/571,135

(22) Filed: Jan. 7, 2022

(65) Prior Publication Data

US 2022/0225041 A1 Jul. 14, 2022

(30) Foreign Application Priority Data

Jan. 8, 2021 (FR) ..... FR 21 00166

(51) Int. Cl.
*H04R 29/00* (2006.01)
*H04R 3/00* (2006.01)
*H04S 1/00* (2006.01)

(52) U.S. Cl.
CPC ..... *H04R 29/001* (2013.01); *H04R 3/00* (2013.01); *H04S 1/007* (2013.01)

(58) Field of Classification Search
CPC ..... H04R 29/001; H04R 3/00; H04S 1/007
See application file for complete search history.

(56) References Cited

U.S. PATENT DOCUMENTS 10,110,263 B2 * 10/2018 Giraldo ..... H03M 1/06
2015/0289072 A1 10/2015 Gyllensward et al.
2019/0079146 A1 3/2019 Romero et al.

FOREIGN PATENT DOCUMENTS

EP 3 242 404 A1 11/2017
FR 2940565 A1 6/2010

OTHER PUBLICATIONS

French Search Report, from the French Patent Office in counterpart French Application No. 2100166, dated Sep. 17, 2021.

* cited by examiner

*Primary Examiner* — David L Ton
(74) *Attorney, Agent, or Firm* — ArentFox Schiff LLP

(57) ABSTRACT

The present invention relates to a device for generating sound messages, comprising:

a generation chain configured to generate a first and a second sound signal carrying a useful audio signal and a test audio signal;

a conversion chain configured to transform the first and second sound signals into first and second analog signals; and a verification chain configured to extract the test audio signal from a combination of the analog signals to verify the integrity of the useful audio signal.

The first sound signal corresponds to the sum of the test audio signal and the useful audio signal, and the second sound signal corresponds to the sum of the test audio signal and an opposite signal corresponding to the opposite of the useful audio signal.

12 Claims, 3 Drawing Sheets

DEVICE FOR GENERATING SOUND MESSAGES AND ASSOCIATED VERIFICATION METHOD

CROSS-REFERENCE TO RELATED APPLICATIONS

This application claims priority to French Application No. 21 00166 filed on Jan. 8, 2021. The disclosure of the priority application is incorporated in its' entirety herein by reference.

FIELD OF THE INVENTION

The present invention relates to a device for generating sound messages.

The present invention also relates to a method for verifying sound messages associated with this generating device.

The invention remains particularly applicable in the avionics field, where verification of the integrity of sound messages transmitted from one or more computers to the pilot or any other user plays an important role, for example.

BACKGROUND OF THE INVENTION

Indeed, in an avionics context, some computers generate audio messages intended for the pilot, for example.

These are warning sounds or short voice messages in particular.

Insofar as these messages or alerts are associated with flight safety, it is important to ensure the good integrity and availability of the electronic function that generates these audio messages.

Thus, there are security mechanisms in place in an aircraft to ensure that the messages transmitted are indeed those desired.

An example of such a mechanism is described in document FR 2940565.

The safety mechanism described in this document proposes transmitting a test signal at the same time as the useful signal comprising the message intended for the pilot or any other user.

To distinguish the test signal from the useful signal, the test signal is typically transmitted in a frequency band that is not audible. The useful signal can be made clean before being sent to the audible audio by using a suitable transformer.

This mechanism also describes an analysis module, arranged before the transformer, allowing the test signal to be extracted following its superimposition with the useful signal. This extraction is implemented by a greater or lesser filtering depending on the nature of the emitted useful signal as well as the test signal.

However, this mechanism has a number of drawbacks.

First, the use of an audio signal that is not audible does not make it possible to be sure that the system is working correctly in the audible frequency band.

Further, in order to be able to extract the test signal later, it is sometimes necessary to adapt this test signal depending on the useful signal. In particular, distinguishing two signals is complex, or even impossible, when the useful signal has a frequency close to that of the test frequency.

It is thus conceivable in the proposed mechanism that the test signal characteristics are constrained by the useful signal. Moreover, the extraction of the test signal can be complex.

SUMMARY OF THE INVENTION

The object of the present invention is to propose a mechanism for generating sound messages wherein the test signal characteristics are no longer constrained by the useful signal. Further, the extraction of the test signal is particularly simple and reliable.

To this end, the invention relates to a device for generating sound messages, comprising a generation chain configured to generate a first sound signal and a second sound signal carrying a useful audio signal and a test audio signal; a conversion chain comprising two transformation channels, each transformation channel being configured to transform the first or second sound signal into a respective first or second analog signal, and a verification chain configured to extract the test audio signal from a combination of the first and the second analog signal, to verify the integrity of the useful audio signal.

The device is characterized in that the first sound signal corresponds to the sum of the test audio signal and the useful audio signal, and in that the second sound signal corresponds to the sum of the test audio signal and an opposite signal corresponding to the opposite of the useful audio signal.

According to further advantageous aspects of the invention, the device according to the invention comprises one or more of the following characteristics, taken alone or in any technically possible combinations:

- a speaker and a transformer, the transformer being connected between the speaker and the converter chain and being configured to generate a resulting signal for the speaker from a differential portion of the first analog signal and the second analog signal;
- the first and the second sound signal are digital signals; the conversion chain is a digital-to-analog conversion chain:
- the digital-to-analog conversion chain comprises a stereo digital-to-analog converter comprising a right and left channel, said channels forming said first and second transformation channels;
- the generation chain comprises a generation module, configured to digitally generate the useful audio signal, from a plurality of digital useful audio signal samples, and the test audio signal, from a plurality of digital test signal samples; and a mixer configured to digitally combine the useful audio signal and the test audio signal, to obtain the first and second sound signal;
- the test signal is a sinusoidal signal;
- the test chain comprises an adding device, configured to analogically add the first and second analog signal to obtain an intermediate signal;
- the verification chain further comprises an analog-to-digital converter, configured to digitize the test signal obtained by the adding device or a signal obtained after dividing said signal obtained by the adding device; an acquisition module, configured to acquire the digitized test signal, to generate a plurality of samples thereof and to extract a plurality of characteristics therefrom; and
- an analysis module, configured to analyze the characteristics extracted by the acquisition module, to determine a disturbance in the test signal;
- said test signal characteristics include at least one of the group consisting of:
  - a maximum value of said samples;
  - a minimum value of said samples; and
  - a number of transitions of said samples through zero;

a control module, configured to trigger a simultaneous emission of the first and second sound signal by the generation chain, to store information relating to the emission date and duration of the corresponding sound message and to transmit this information to the analysis module, the analysis module being configured to analyze said information and the corresponding test signal characteristics, to detect a loss of integrity of the useful audio signal;

the device is integrated in an aircraft piloting system.

The present invention also relates to a verification method comprising the following steps:

generating a first and second sound signal, carrying a useful audio signal and a test audio signal;

transforming the first and second sound signal into respective first and second analog signals by means of two different transformation channels;

extracting the test audio signal from a combination of the first and second analog signals, to verify the integrity of the useful audio signal;

the method being characterized in that the first sound signal corresponds to the sum of the test audio signal and the useful audio signal, and in that the second sound signal corresponds to the sum of the test audio signal and an opposite signal corresponding to the opposite of the useful audio signal.

BRIEF DESCRIPTION OF THE DRAWINGS

These characteristics and advantages of the invention will become clearer upon reading the following description, given only as a non-limiting example and made with reference to the appended drawings in which.

DETAILED DESCRIPTION OF THE INVENTION

Figure 1:
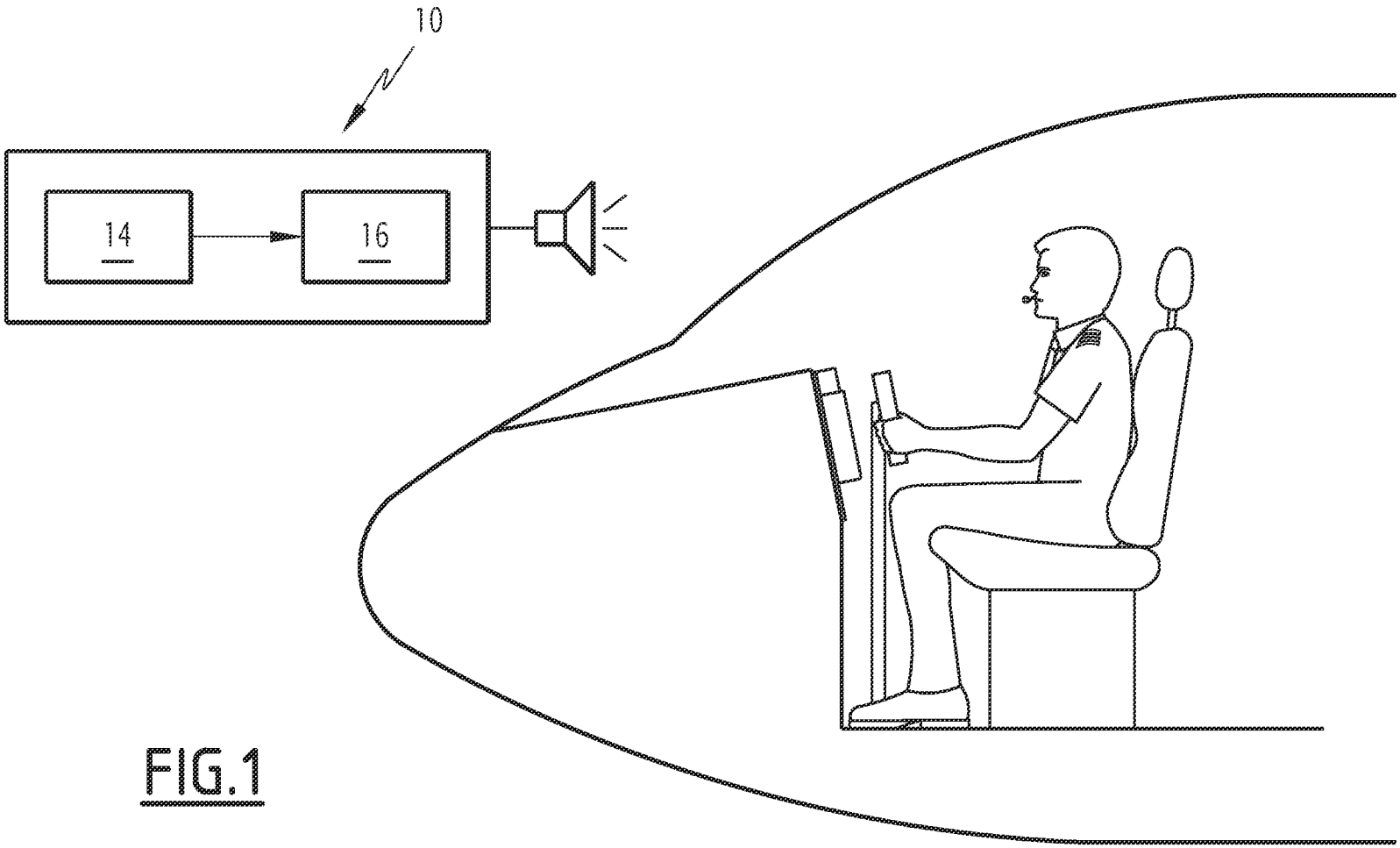
FIG. 1 is a schematic view of a piloting system comprising a device for generating sound messages according to the invention.

The piloting system 10 is shown in FIG. 1.

In the example of this Figure, the piloting system 10 is used by a pilot flying an aircraft, using sound messages, at least partially. In a variant, the piloting system 10 is used by any other user such as a maintenance operator, for example.

By aircraft, we mean any flying machine that can be piloted by a pilot from the cockpit of this machine or, in a variant, by a pilot or any other user, at a distance from it. In the latter case, the pilot may also be called the operator.

In the first case, it is a plane or helicopter, for example. In the second case, it is a drone, for example, which is then remotely controllable. In the first case, the piloting system 10 is therefore onboard the aircraft, whereas the piloting system 10 in the second case is at least partially located in a ground control center, for example.

Of course, other piloting system embodiments are also possible. In other words, the piloting system and in particular the device for generating sound messages can be used in any other field requiring a high safety level (such as the rail/nuclear/medical fields etc.).

In the example shown in FIG. 1, the piloting system 10 comprises a computer 14 and a device for generating sound messages 16, according to the invention.

The computer 14 is a computer known per se, usable by the pilot to pilot the aircraft, for example. The computer 14 makes it possible to send sound message emission commands in particular to the device for generating sound messages.

These emission commands are emitted by the computer 14, for example, depending on the actions carried out by the pilot in relation to control elements associated with the computer 14, for example. Thus, the sound message emission commands issued by the computer 14 present a means of communication to the pilot.

Each emission command corresponds to an alert or voice message emission command intended for the pilot, for example, and is presented in the form of a digital data frame, for example.

The computer 14 is connected to the device for generating sound messages 16 by a digital data transmission bus, for example.

According to another example embodiment, the device for generating sound messages 16 is integrated into the computer 14 and is therefore connected to the computer 14 via internal circuitry.

The device for generating sound messages 16 is used to generate sound messages for the pilot from the emission commands transmitted by the computer 14.

Although the device for generating sound messages 16 is associated with the piloting system 10 in the present description, it should be noted that this generating device 16 can be used independently of the piloting system 10 and the computer 14, as previously described.

For example, in the avionics context, the device for generating sound messages 16 may be associated with multiple computers and thus multiple flight systems.

Further, the generating device 16 can be used outside the avionics context, for piloting any other vehicle, for example, or when using any other electronic and/or mechanical device for which integrity is important, such as a medical device.

The device for generating sound messages 16 will now be explained in more detail with reference to FIG. 2.

Figure 2:
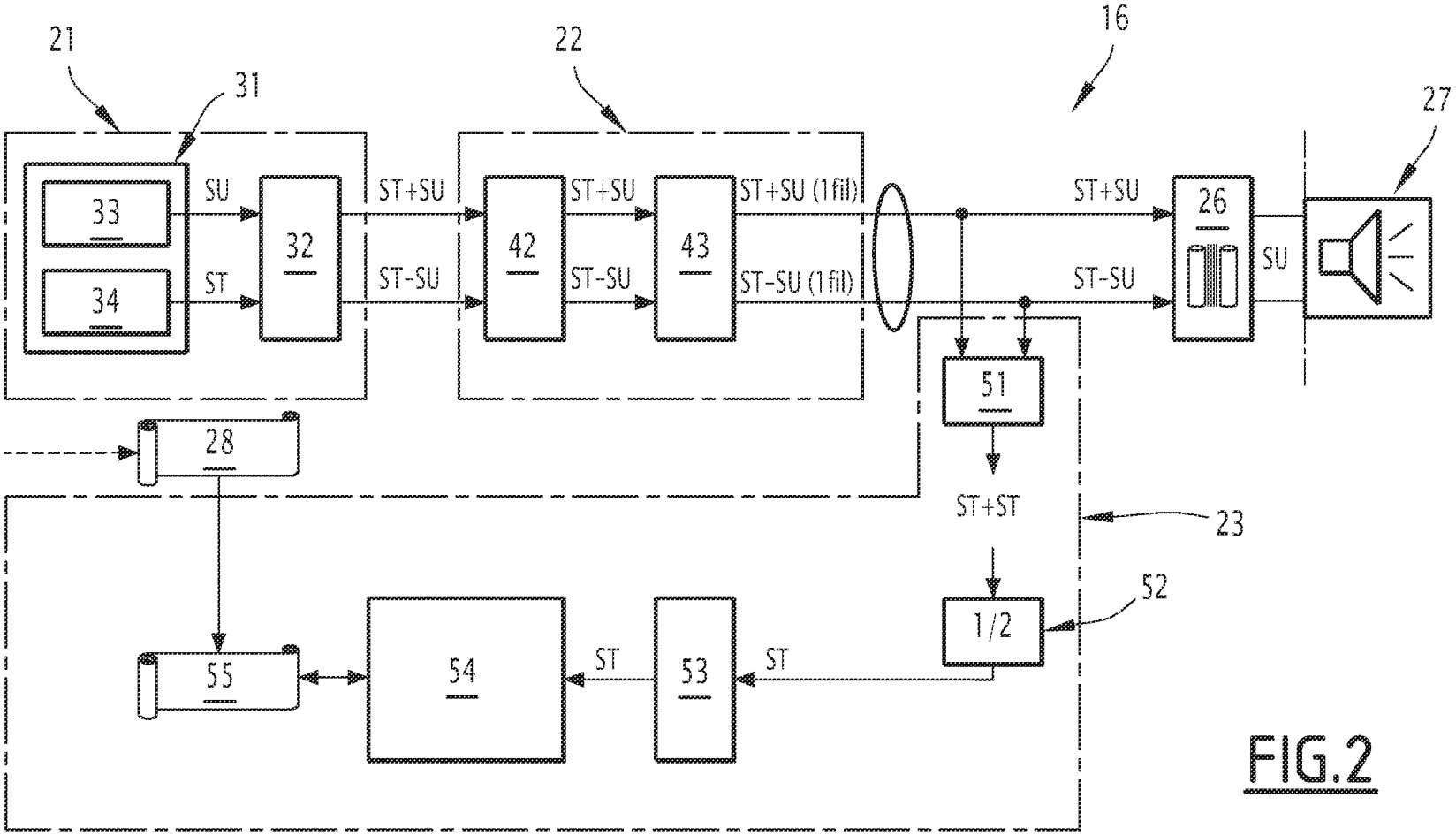
FIG. 2 is a detailed schematic view of the device for generating sound messages of FIG. 1.

Thus, as illustrated in FIG. 2, the device for generating sound messages 16 comprises a generation chain 21 configured to digitally generate a first and second digital signal, carrying a useful audio signal and a test audio signal, a digital-to-analog conversion chain 22 comprising two channels for transforming said digital signals to form a respective first or second analog signal, and a verification chain 23, configured to extract the test audio signal to verify the integrity of the useful audio signal from a combination of said analog signals.

In another (non-illustrated) embodiment of the device for generating sound messages 16, the generation chain 21 is configured to generate two analog signals instead of the first and second digital signal, called first and second sound signals, carrying a useful audio signal and a test audio signal. The properties of these sound signals and their generation methods are analogous to those of the first and second digital signal, and will not be explained in detail in relation to this embodiment. In particular, the first sound signal corresponds to the sum of the test audio signal and the useful audio signal, and the second sound signal corresponds to the sum of the test audio signal and an opposite signal corresponding to the opposite of the useful audio signal. Further, in this embodiment, the device 16 is has no digital-to-analog conversion chain 22, but includes a conversion chain 22 of any other type. This conversion chain 22 has a transmission channel for the useful and test audio signals, for example. Other components of the device for generating sound messages 16 according to this embodiment are similar to those explained below in connection with the device for generating sound messages 16 of FIG. 2.

With reference to FIG. 2, the device for generating sound messages 16 further includes a speaker 27 and a transformer 26, connecting the speaker 27 to the digital-to-analog conversion chain 22.

In the example of FIG. 2, the device for generating sound messages 16 further includes a control module 28, configured to control the signal emission from the generation chain 21. In particular, in the example of FIG. 2, the control module 28 is configured to receive emission commands issued by the computer 14 and to control the generation chain 21 in accordance with these commands.

As illustrated in FIG. 2, the generation chain 21 comprises a generation module 31 and a mixer 32.

The generation module 31 is configured to digitally generate a useful audio signal corresponding to the emission command received by the control module 28. To do so, the generation module 31 is able to use a plurality of digital samples of useful audio signals contained in a first database 33, for example. In particular, this first database 33 may include a digital sample for each emission command likely to be received by the control module 28, for example.

The generation module 31 is further configured to generate a test audio signal simultaneously with the generation of each useful audio signal, from a plurality of digital test signal samples, for example. These digital test signal samples are stored in a second database 34, for example, also visible in FIG. 2. In a variant, each test audio signal is generated "on the fly" for each useful audio signal, based on predetermined parameters for this test audio signal.

Advantageously, according to the invention, each test audio signal is chosen independently of the corresponding useful audio signal or at least independently of the frequency spectrum of this useful audio signal. In some embodiments, the same test audio signal may be chosen for each useful audio signal, or at least for a group of useful audio signals.

Each test audio signal is selected from within the audible frequency band (20 to 20,000 Hz), for example.

According to one particular example of the invention, each test audio signal is chosen as a sinusoidal signal, the frequency of which makes it possible to obtain at least a hundred or a few hundred periods during the duration of the corresponding useful audio signal.

For example, if the duration of the corresponding useful audio signal is one second, the test audio signal frequency is chosen to be at least 100 Hz. It is possible to choose a higher frequency (such as 1 KHz), to give better accuracy. According to one example, for the duration of a beep (500 ms), which is the shortest sound, the frequency can be chosen as around 1 kHz. This gives about 500 periods.

Further, for successively transmitted test audio signals, it is possible to choose several frequencies. These frequencies can be chosen to be constant during a given useful audio signal but different from one useful audio signal to another. This then makes it possible to scan the entire audible frequency spectrum. Thus, as will become apparent later, it will be possible to detect failures that occur only at certain frequencies.

The mixer 32 is configured to digitally combine each useful audio signal and each test audio signal from the generation module 31 to obtain a first and second digital signal corresponding to these useful and test audio signals.

In particular, according to the invention, these digital signals are generated so that the first digital signal corresponds to the sum of the test audio signal and the useful audio signal, and the second digital signal corresponds to the sum of the test audio signal and an opposite signal corresponding to the opposite of the useful audio signal.

In other words, following such mixing by the mixer 32, the useful audio signal is carried by a balanced differential digital signal comprising two branches, corresponding to the respective first and second digital signal. These two branches are then opposite each other.

As for the test signal, it is added in common, i.e. it is equal on both branches of the differential digital signal.

According to one example of the invention, the mixer 32 is implemented in the form of software.

According to another example of the invention, the mixer 32 is implemented in the form of a hardware component allowing the combination of said signals.

In this case, the mixer 32 has two inputs capable of receiving two different digital signals. In this case, it is possible to periodically alternate the two mixer inputs, so that the test audio signal alternately passes through the same internal mixer path as the useful audio signal.

According to one particular example of the invention, the mixer 32 is integrated into the digital-to-analog conversion chain 22 and has a commercial, off-the-shelf (COTS) component of this chain, for example.

According to the above-mentioned examples, the two-signal combination, i.e. the useful audio signal and the test audio signal, is carried out at the time of emission of the corresponding useful audio signal.

According to another example embodiment, the combination of these signals is already carried out beforehand and the results thereof are suitably stored, for example. In this case, the mixer 32 is not required and the generation module 31 is adapted to directly select the first and second digital signal directly from the respective first database 32 and second database 34, from the corresponding emission command.

The digital-to-analog conversion chain 22 comprises two transformation channels. Each transformation channel is configured to receive each first or second digital signal from the mixer 32, to transform it into a respective first or second analog signal.

In the example shown in FIG. 2, the digital-to-analog conversion chain 22 comprises an acquisition interface 42 and a digital-to-analog converter 43.

In particular, the acquisition interface 42 allows the digital-to-analog converter 43 to be connected to the mixer 32 and defines two input ports for this purpose, namely a first input port, adapted to receive the first digital signal, and a second input port, adapted to receive the second digital signal. Then, the acquisition interface 42 is adapted to transmit these acquired signals to the digital-to-analog converter 43.

The digital-to-analog converter 43 is configured to transform each of the first and second digital signals into a respective first and analog signal.

Advantageously, according to the invention, the digital-to-analog converter 43 has a stereo converter, i.e. a converter whose transformation channels correspond to a right and a left channel. In this case, the digital-to-analog converter 43 is adapted to receive the first digital signal on its left channel and to transform it into the first analog signal on the same left channel, for example. Similarly, the digital-to-analog converter 43 is adapted to receive the second digital signal on its right channel and to transform it into a second analog signal on this same right channel, for example.

According to another embodiment, the digital-to-analog converter 43 takes the form of two mono digital-to-analog converters.

The digital-to-analog converter 43 is connected to the transformer 26, for example, via a stereo cable comprising two wires: a first wire corresponding to the left channel, carrying the first analog signal, and a second wire corresponding to the right channel, carrying the second analog signal, to the transformer 26.

In one particular embodiment of the invention, the digital-to-analog converter 43 further comprises an amplifier, adapted to amplify each analog signal delivered following its digitization.

The transformer 26 is configured to generate a resulting signal for the speaker 27 from the received first and second analog signal. In particular, the transformer 26 is configured to react only on the differential part of two received signals, and thus to ignore the common mode of the two received signals.

Thus, according to the invention, the resulting signal delivered to the speaker 27 corresponds exactly to the useful audio signal generated by the generation module 31. The verification chain 23 is connected between the digital-to-analog conversion chain 22 and the transformer 26.

Thus, the verification chain 22 is configured to receive the first and second analog signal and to extract the test signal from them.

To do so, the verification chain 22 comprises an adding device 51, configured to analogically add the first and second analog signal, and a dividing bridge 52, for example, configured to divide an intermediate signal obtained by the adding device 51 by two. According to another embodiment, the verification chain 22 has no dividing bridge 52.

In particular, it is clear from the construction of the first and second analog signals that the adding device 51 provides an intermediate signal with amplitudes twice that of the test audio signal.

In this context, the dividing bridge 52 makes it possible to divide these amplitudes by two and thus obtain the test audio signal as generated by the generation module 31. In the embodiment in which the verification chain 22 is has no divider bridge, the signal obtained by the adding device 51 is sent directly to the components of the verification chain 22, explained in detail later. In this case, the processing of this signal is carried out by taking into account double these amplitudes as compared to the test audio signal.

As illustrated in FIG. 2, the verification chain 22 further comprises an analog-to-digital converter 53, configured to digitize the test signal obtained by the dividing bridge 52 and an acquisition module 54, configured to acquire the test audio signal digitized by the analog-to-digital converter 53.

The acquisition module 54 is further configured to generate a plurality of samples relating to the acquired digitized test signal, to extract a plurality of characteristics thereof.

Advantageously, according to the invention, said characteristics of the test signal comprise at least one element selected from the group comprising:

the maximum value of said samples;

the minimum value of said samples;

a number of transitions of said samples through zero.

According to one particular embodiment, said characteristics are determined in relation to a transformed signal of the test signal, according to an FFT type transformation, for example.

In relation to the maximum and minimum values of said samples, the acquisition module 54 is adapted to complete these samples, for example, by adding the entire signal, either in its entirety or individually, for example, on the positive and negative part. Once associated with the maximum and minimum values of this signal, this gives information on the shape of the signal.

In relation to the number of transitions through zero, the acquisition module 54 implements a count of the sign changes of the digitized samples, for example, with some margin in relation to zero, to get rid of noise. For example, a zero passage may be validated when these samples change from a value greater than 100 mV to a value less than −100 mV.

According to another example, the test signal samples may be supplemented with additional thresholds. For example, if a test signal with a sinusoidal shape and an amplitude of 1 V is expected, it is possible to add transition counters at 0.5 V and at −0.5 V that will indicate that the minimum and maximum values measured are not exceptions, but are reached regularly.

Advantageously, according to the invention, the acquisition module 54 takes the form of a hardware component, composed of a plurality of circuits configured solely to calculate said test signal characteristics. In a variant, the acquisition module 54 takes the form of software.

The verification chain 23 further comprises an analysis module 55 that is configured to analyze the test signal characteristics generated by the acquisition module 54.

Further, the analysis module 55 is additionally configured to analyze information relating to the emission date of each useful audio signal as well as the duration of that signal.

In particular, upon emission of the useful audio signal with the corresponding test audio signal, the control module 28 is configured to determine the date of this event as well as the duration of the useful audio signal. The duration may be determined by analyzing the size in bytes of this useful audio signal.

The control module 28 is additionally configured to transmit this information, including the message transmission date as well as its duration, to the analysis module 55.

In this case, the analysis module 55 is configured to control that the test audio signal is absent when there is no useful audio signal emission, and the test signal is indeed present when there is a useful audio signal emission. In addition, the analysis module 55 is configured to analyze the received test signal characteristics continuously, to detect irregularities over a time period.

In one advantageous embodiment of the invention, the analysis module 55 is adapted to store information relating to the previous audio signal. Thus, if a useful audio signal ends and another one begins in the same time period, the information is kept by the analysis module 55, to know this as well as the emission times and the durations of both signals.

Figure 3:
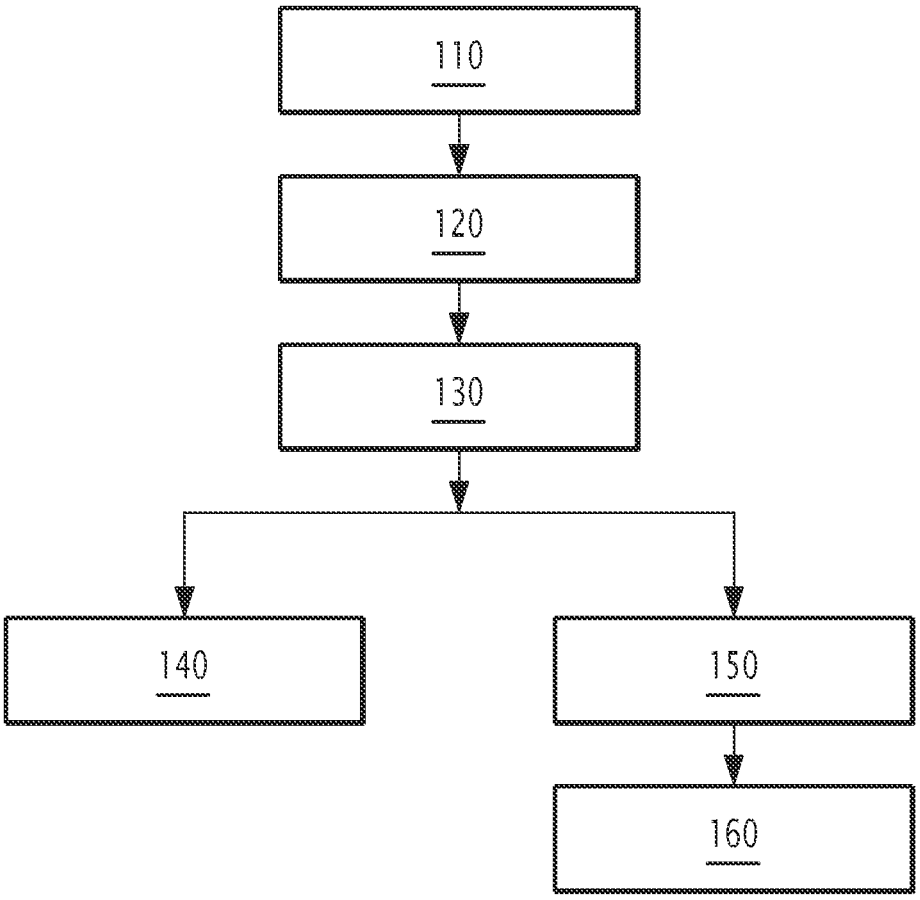
FIG. 3 is a flowchart of a method for verifying sound messages according to the invention, the method being implemented by the device for generating sound messages of FIG. 2.

The method for verifying sound messages implemented by the device for generating sound messages 16 will now be explained with reference to FIG. 3, which shows a flowchart of these steps.

In an initial step 110, the control module 28 receives an sound message emission command from the computer 14.

The control module 28 then triggers the generation of a useful audio signal SU corresponding to this emission command and a corresponding test audio signal ST.

The control module 28 transmits the emission date and duration of the useful audio signal SU to the analysis module 55.

In the next step 120, the generation chain 21 then generates a first digital signal SN1 and a second digital signal SN2 carrying the useful audio signal SU and the test audio signal ST. In particular, the first digital signal SN1 is equal to the sum ST+SU of these signals and the second digital signal SN2 is equal to the sum ST-SU of the test audio signal ST and the opposite signal −SU of the useful audio signal SU.

In a subsequent step 130, the digital-to-analog conversion chain 22 converts the first digital signal SN1 and the second digital signal SN2 into a respective first analog signal SA1 and a second analog signal SA2, using two different transformation channels.

In the next step 140, the transformer 26 receives the first analog signal SA1 and the second analog signal SA2 transmitted by a stereo cable, for example, and generates a resulting signal comprising only the differential part of two signals. The resulting signal then corresponds to the useful audio signal SU initially generated by the generation module 31. Then, the transformer 26 transmits this signal to the speaker 27.

In step 150, implemented in parallel with step 140, for example, the verification chain 22 extracts the test signal from the sum of the first analog signal SA1 and the second analog signal SA2, using the adding device 51 and the dividing bridge 52, as previously explained.

Then, the analog-to-digital converter 53 digitizes this test signal, which is received by the acquisition module 54. This acquisition module 54 then samples this digitized signal to extract characteristics from it, as defined previously.

In the next step 160, the analysis module 55 analyzes the test signal characteristics extracted by the acquisition module 54 with the information provided by the control module 28.

When a test signal failure or disturbance is detected, the analysis module 55 warns the control module 28, for example.

The latter can then repeat the useful audio signal emission, or else notify another monitoring system.

It is thus conceivable that the present invention has a number of advantages.

First, the particular shape of the first and second digital signal makes it possible to extract the useful audio signal easily after digitization thereof by a digital-to-analog converter. In fact, it is only necessary to configure the transformer to govern a differential part of this signal, without requiring the use of special filters. This makes it possible to use any form of test signal without them having any constraints.

Moreover, it is also particularly easy to extract the test signal. Indeed, simply adding the first and second analog signal with a subsequent division is sufficient to do so.

No filtering is necessary at this stage.

Finally, the whole set of components of the device for generating sound messages can be implemented in one particularly simple and inexpensive way.

This makes it possible to detect not only a failure during the emission of sound messages, but also disturbances within them.

The invention claimed is:

1. A device for generating sound messages, comprising:

a generation chain configured to generate a first sound signal and a second sound signal, carrying a useful audio signal and a test audio signal;

a conversion chain comprising a first transformation channel and second transformation channel, the respective first and second transformation channel being configured to transform the respective first and second sound signal into a respective first and second analog signal;

a verification chain, configured to extract the test audio signal from a combination of the first analog signal and second analog signal, to verify the integrity of the useful audio signal;

the first sound signal corresponding to the sum of the test audio signal and the useful audio signal, and the second sound signal corresponding to the sum of the test audio signal and an opposite signal corresponding to the opposite of the useful audio signal.

2. The device according to claim 1, further comprising a speaker and a transformer;

the transformer being connected between the speaker and the conversion chain and being configured to generate a resulting signal for the speaker from a differential portion of the first analog signal and the second analog signal.

3. The device according to claim 1, wherein:

the first and second sound signals are digital signals;

the conversion chain is a digital-to-analog conversion chain.

4. The device according to claim 3, wherein the digital-to-analog converter chain comprises a stereo digital-to-analog converter, comprising a right and left channel, said channels forming said first and second transformation channels.

5. The device according to claim 3, wherein the generation chain comprises:

a generation module configured to digitally generate the useful audio signal from a plurality of digital useful audio signal samples and the test audio signal from a plurality of digital test signal samples; and a mixer configured to digitally combine the useful audio signal and the test audio signal to obtain the first sound signal and the second sound signal.

6. The device according to claim 1, wherein the test signal is a sinusoidal signal.

7. The device according to claim 1, wherein the verification chain comprises an adding device, configured to analogically add the first and second analog signal, to obtain an intermediate signal.

8. The device according to claim 7, wherein the verification chain further comprises:

an analog-to-digital converter configured to digitize the test signal obtained by the adding device or a signal obtained after dividing said signal obtained by the adding device;

an acquisition module configured to acquire the digitized test signal, to generate a plurality of samples thereof and to extract a plurality of characteristics therefrom;

an analysis module configured to analyze the characteristics extracted by the acquisition module to determine a disturbance in the test signal.

9. The device according to claim 8, wherein said characteristics of the test signal comprise at least one selected from the group consisting of:

a maximum value of said samples;

a minimum value of said samples; and a number of transitions of said samples through zero.

10. The device according to claim 8 further comprising a control module configured to trigger a simultaneous emission of the first and second sound signal by the generation chain, to store information relating to the emission date and duration of the corresponding sound message and to transmit this information to the analysis module;

the analysis module being configured to analyze said information and the characteristics of the corresponding test signal to detect a loss of integrity of the useful audio signal.

11. The device according to claim 1, integrated in an aircraft piloting system.

12. A method for verifying sound messages comprising the following steps:

generating a first and second sound signal, carrying a useful audio signal and a test audio signal;

transforming the first and second sound signal into a respective first and second analog signal by two different transformation channels, extracting the test audio signal from a combination of the first and second analog signal, to verify the integrity of the useful audio signal;

the first sound signal corresponding to the sum of the test audio signal and the useful audio signal, and the second sound signal corresponding to the sum of the test audio signal and an opposite signal corresponding to the opposite of the useful audio signal.

* * * * *